United States Patent [19]

Adachi et al.

[11] Patent Number: 5,060,014

[45] Date of Patent: Oct. 22, 1991

[54] IMAGE FORMING APPARATUS AND DETACHABLE PROCESS KIT UTILIZING A DRUM CHARGING MEANS IN RELATIVELY LIGHT CONTACT PRESSURE THEREWITH

[75] Inventors: Hiroyuki Adachi, Tokyo; Noribumi Koitabashi, Yokohama, both of Japan

[73] Assignee: Canon Kabushiki Kaisha, Tokyo, Japan

[21] Appl. No.: 505,156

[22] Filed: Apr. 5, 1990

[30] Foreign Application Priority Data

Apr. 5, 1989 [JP] Japan ..... 1-87387

[51] Int. Cl.[5] ..... G03G 15/02; G03G 15/21

[52] U.S. Cl. ..... 355/211; 355/219; 355/299

[58] Field of Search ..... 355/210, 211, 219, 299; 361/225

[56] References Cited

U.S. PATENT DOCUMENTS

| | | | |
|---|---|---|---|
| 4,530,594 | 7/1985 | Adachi . | |
| 4,639,123 | 1/1987 | Adachi et al . | |
| 4,851,960 | 7/1989 | Nakamura et al. | 361/225 |

FOREIGN PATENT DOCUMENTS

| | | | |
|---|---|---|---|
| 0312230 | 4/1990 | European Pat. Off. | 355/299 |
| 56-91253 | 7/1981 | Japan . | |
| 56-104349 | 8/1981 | Japan . | |
| 56-165166 | 12/1981 | Japan . | |
| 60-147756 | 8/1985 | Japan . | |
| 63-58478 | 3/1988 | Japan | 355/299 |
| 1-63989 | 3/1989 | Japan | 355/299 |

*Primary Examiner*—Joan H. Pendegrass

*Attorney, Agent, or Firm*—Fitzpatrick, Cella, Harper & Scinto

[57] ABSTRACT

An image forming apparatus or a process kit detachable relative to such an apparatus in which the contact pressure of a blade-like charging member to an image carrying member is made smaller than the contact pressure of a blade-like cleaning member to the image carrying member. This relationship reduces abrasion and damage of the image carrying member, and makes it possible uniformly and stably to charge the image carrying member.

29 Claims, 3 Drawing Sheets

IMAGE FORMING APPARATUS AND DETACHABLE PROCESS KIT UTILIZING A DRUM CHARGING MEANS IN RELATIVELY LIGHT CONTACT PRESSURE THEREWITH

BACKGROUND OF THE INVENTION

1. Field of the Invention

This invention relates to an image forming apparatus, such as an electrophotographic copier, a printer or the like, and a process kit which is detachable relative to the image forming apparatus, and to an image forming apparatus which includes a blade-like cleaning member for cleaning an image carrying member after the transfer of an image and a blade-like charging member provided at a downstream side in the direction of movement of the image carrying member from the blade-like cleaning member, and a process kit which is detachable relative to the image forming apparatus.

2. Description of the Related Art

As concrete examples of the image forming apparatus of the type as described above, there exists an electrophotographic copier using a transfer method, an electrostatic recording apparatus using a transfer method, and the like.

In an electrophotographic copier using a transfer method, a drum-type or endless-belt-type electrophotographic photosensitive member which rotates or which is rotatably driven is used as an image carrying member, and a developed image is formed by applying an image forming process means based on uniformly charging the surface of the photosensitive member, and exposing and developing an image on the surface. The developed image is then transferred to the surface of a transfer material by a transfer means, the transferred developed image is fixed on the surface of the transfer material by a fixing means, and the transfer material is output as the copied image. The surface of the photosensitive member after the transfer of the image is cleaned by a cleaning means, and is repeatedly utilized for forming images.

In an electrostatic recording apparatus using a transfer method, a drum-type or endless-belt-type dielectric member which rotates or which is rotatably driven is used as an image carrying member, and a developed image is formed by applying an image forming process means based on uniformly charging the surface of the dielectric member, selectively removing electric charges from the surface and developing an image formed on the surface. Subsequently, the transfer and fixing operations of the developed image to the surface of a transfer material is executed in the same way as in the above-described electrophotographic copier, and the transfer material is output as the recorded image. The surface of the dielectric member after the transfer of the image is cleaned by a cleaning means, and is repeatedly utilized for forming images.

The cleaning means removes untransferred developer (toner), paper powder of the transfer material and other adhering contaminants which remain on the surface of the image carrying member (photosensitive member, dielectric member or the like) after the transfer of the image to the transfer material. A rubber elastic member made of urethane rubber or the like is generally used as the cleaning member, which is configured so that contaminants adhered on the surface of the image carrying member are wiped off and removed by contacting the cleaning member with the surface of the image carrying member.

As the means for uniformly charging the surface of the image carrying member, a corona discharge unit having a corona wire electrode and a shield electrode surrounding it and having a uniform charging property, such as a corotron, a scorotron or the like, has widely been used. However, the corona discharge unit has problems in that an expensive high-voltage power supply is needed. Further, miniaturization is difficult since certain minimum spacing is needed, such as a shield space for applying high voltage to the wire electrode, and the like. Furthermore, since corona byproducts, such as ozone and the like, are generated in a large amount, additional means and mechanisms are needed for dealing with the by-products, all of which are factors which tend to make the apparatus large and costly.

Accordingly, adoption of a contact charging method in place of a corona charging unit has recently been investigated. In the contact charging method, electric charges are directly injected onto the surface of an image carrying member by contacting a conductive member (a contact charging member), to which voltage (for example, D.C. voltage of about 1–2 kV (kilovolts), superposed voltage of D.C. voltage and A.C. voltage, or the like) is applied from a power supply, to the surface of the image carrying member as a member to be charged. The surface of the image carrying member is thereby charged at predetermined potential. There have been devised a roller charging method (Japanese Patent Public Disclosure (Kokai) No. 56-91253 (1981)), a blade charging method (Japanese Patent Public Disclosure (Kokai) Nos. 56-104349 (1981) and 60-147756 (1985)), a charging and cleaning method (Japanese Patent Public Disclosure (Kokai) No. 56-165166 (1981)), and the like.

In the contact charging method, it is important for the charging member to contact each portion of the image carrying member uniformly along its longer direction. If a uniform contact state is not provided, there is produced an unevenly charged state on the surface of the image carrying member.

From the viewpoint of providing a simplified and low-cost apparatus, the blade charging method as disclosed, for example, in the aforementioned Japanese Patent Public Disclosure (Kokai) No. 56-104349 (1981) is most preferred.

In some cases, however, uniform charging is not obtained due to abrasion and damage of the surface of the image carrying member caused by the fact that a blade-like contact charging member and a blade-like cleaning member contact the image carrying member in a fixed state nearly standing still relative to the movement of the image carrying member.

SUMMARY OF THE INVENTION

The present invention has been made in consideration of the problems as described above.

It is an object of the present invention to provide an image forming apparatus which prevents abrasion and damage of the surface of an image carrying member and which uniformly charges the surface of the image carrying member, and a process kit which is detachable relative to the apparatus.

It is another object of the present invention to provide an image forming apparatus which uniformly charges the surface of an image carrying member by accurately contacting a contact charging member to the image carrying member, that is, by always maintaining a state in which the contact charging member is uniformly and stably contacted to the surface of the image carrying member at each portion along the longer direction of the image carrying member, and a process kit which is detachable relative to the apparatus.

It is still another object of the present invention to provide an image forming apparatus capable of obtaining an excellent image by uniformly charging the surface of an image carrying member, and a process kit which is detachable relative to the apparatus.

DETAILED DESCRIPTION OF THE PREFERRED EMBODIMENT

An embodiment of the present invention will now be explained with reference to the drawings.

Figure 1:
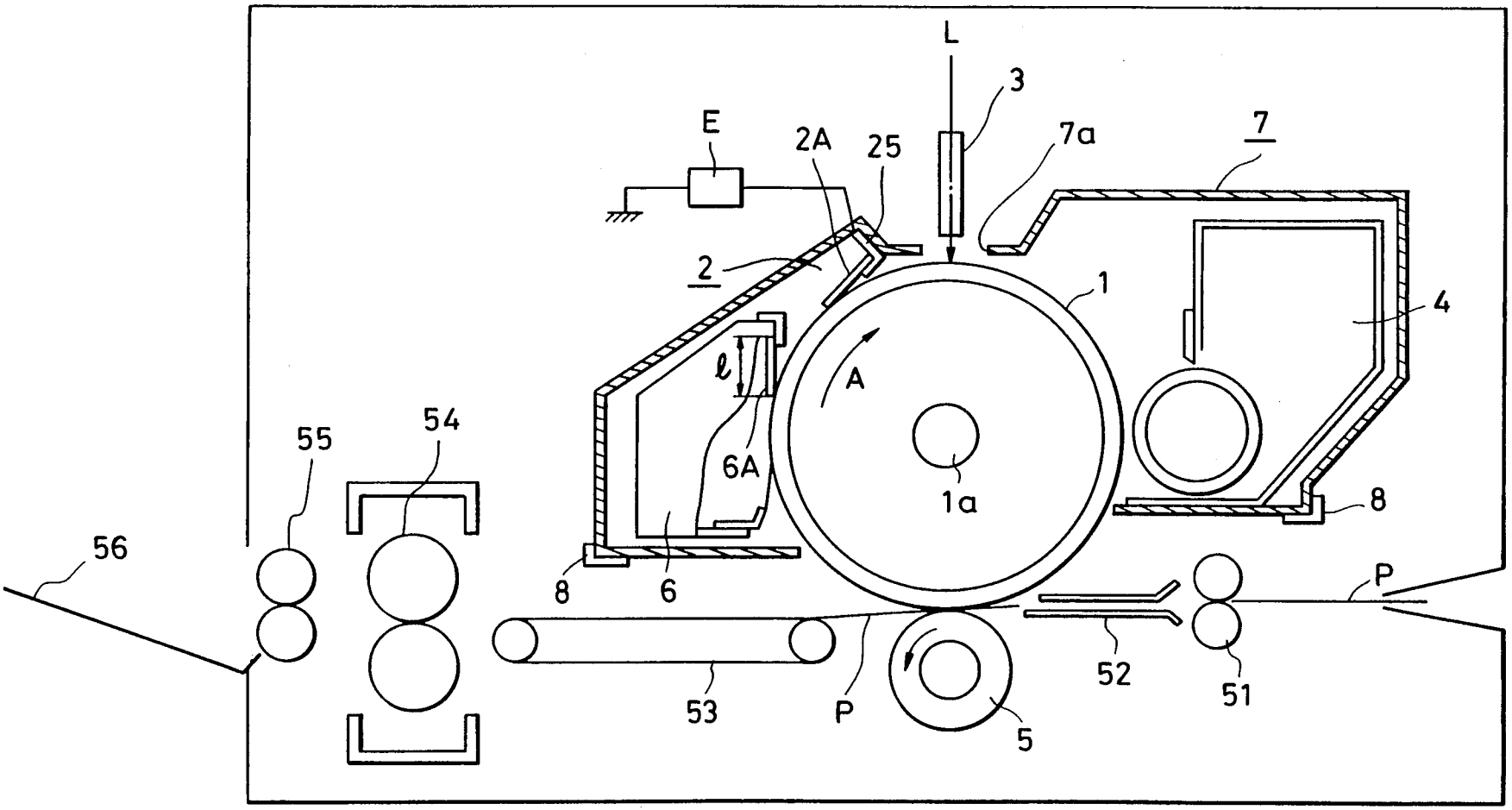
FIG. 1 is a schematic cross-sectional view showing an embodiment of the image forming apparatus and the process kit detachable relative to the apparatus according to the present invention.

FIG. 1 shows an electrophotographic copier using a transfer method of a detachable process-cartridge-type showing an embodiment of the image forming apparatus according to the present invention.

In FIG. 1, a drum-type electrophotographic photosensitive member (abbreviated hereinafter a "photosensitive member") 1 as an image carrying member is rotatably driven in the direction of arrow A around at a predetermined circumferential speed a support shaft 1*a* at the center of rotation. A contact charging member 2 as a means for uniformly charging the circumferential surface of the photosensitive member 1 consists of a conductive elastic blade 2A made of conductive rubber having a volume resistivity of about $10^2$–$10^7$ .cm, such as urethane, EPDM, NBR or the like, or further provided with a resistive layer having a volume resistivity higher than that of the conductive rubber (for example, a volume resistivity of $10^8$–$10^{12}\Omega$.cm) on its surface contacting the photosensitive member 1. Voltage is applied from a power supply E to a conductive support member 25 made of metal for supporting the blade 2A.

There are also shown a short-focus lens array 3 as a light image exposure means, a developing unit 4, and a transfer unit 5. Timing rollers 51 feed a transfer material P conveyed one by one from a paper-feeding unit (not shown) between the photosensitive member 1 and the transfer unit 5 in synchronization with the rotation of the photosensitive member 1. A transfer material guide member 52 is disposed between the timing rollers 51 and the transfer unit 5. A conveying unit 53 guides the transfer material P, on the surface of which an image has been transferred while passing through between the photosensitive member 1 and the transfer unit 5, to a fixing unit 54. A cleaning unit 6 cleans the surface of the photosensitive member 1 after the transfer of the image.

In the present apparatus, the photosensitive member 1, the contact charging member 2, the developing unit 4 and the cleaning unit 6 are configured as a process cartridge 7, that is, a process kit in which these four process units are assembled as a unit with a predetermined positional relationship. The process cartridge 7 may be inserted and mounted within the main body of the copier in the direction perpendicular to the plane of FIG. 1 along support rails 8, 8, and may freely be extracted outside the main body of the copier. The process cartridge 7 is not limited to the configuration as described above, but may have any other configurations provided that the cartridge comprises the photosensitive member 1 as the image carrying member, and at least the contact charging member 2 and the cleaning unit 6 as process units which contribute to the image formation.

By mounting the process cartridge 7 within the main body of the copier, the main body of the copier and the process cartridge are mechanically and electrically coupled with each other, and in this state are operable as a copier.

The circumferential surface of the photosensitive member 1 is sequentially and uniformly charged by the blade 2A as the contact charging member to which oscillating voltage (voltage the value of which periodically changes with time, such as superposed voltage of D.C. voltage and A.C. voltage) is applied from the high-voltage power supply E, and then sequentially receives light-image exposure L (slit exposure in accordance with the image information of an original or the like) while passing the position of the light-image exposure means 3. An electrostatic latent image corresponding to the exposed light image pattern is thus sequentially formed. A light transmitting window aperture 7*a* is opened at a window portion of a cartridge housing which corresponds to the light image exposure means 3. The light image exposure L may also be performed by laser-beam scanning. In the case of an electrostatic recording apparatus, a latent image is sequentially formed on the surface of a photosensitive member by a means for selectively removing electric charges on the surface of the photosensitive member, such as an electrode array or the like. It is possible to provide a uniform charging operation by setting the voltage applied to the charging member so that the peak-to-peak value of the above-described oscillating voltage is twice or more the voltage value to start charging for the image carrying member, as shown in U.S. Pat. No. 4,851,960.

Subsequently, the latent image formed on the surface of the photosensitive member 1 is sequentially developed as a toner image by the developing unit 4. The toner image on the surface of the photosensitive member 1 is then transferred to the surface of the transfer material P, which has been conveyed one by one from a tray or cassette in a paper feeding unit (not shown) between the transfer unit 5 and the photosensitive member 1 by the timing rollers 51 in synchronization with the rotation of the photosensitive member 1, by the transfer unit 5.

The transfer material P to which the image has been transferred while passing through the transfer material 5 is sequentially separated from the surface of the photosensitive member 1, is guided to a fixing unit 54 by a conveying unit 53. The image is fixed in the fixing unit 54, and the transfer material P is output from a paper discharging roller 55 onto a paper discharging tray 56 as the copied image.

Untransferred toner, paper powder of the transfer material P, and other adherent contaminants on the surface of the photosensitive member 1 after the transfer of the image are removed by a cleaning member 6A in the cleaning unit 6. The surface of the photosensitive member 1 is thus cleaned, and is repeatedly used for forming images.

The cleaning member 6A is a blade-like wiping member (termed hereinafter a "cleaning blade") made of urethane rubber or the like the front edge portion of which is contacted to the surface of the photosensitive member 1. Adherent contaminants on the surface of the photosensitive member 1 are scraped off and removed by the cleaning blade 6A.

The contact friction force of the cleaning blade 6A, which is contacted to the surface of the photosensitive member 1, with the photosensitive member 1 becomes large particularly when the photosensitive member 1 has a surface composed of resin, such as an OPC (organic photoconductor) and the like. Hence, scratches caused by rubbing the photosensitive member 1 by the cleaning blade 6A are easily produced on the surface of the photosensitive member 1. Such scratches may naturally cause defects in an image at the moment of forming the image, particularly, defects in the image due to an inferior charging operation.

On the other hand, since paper powder of the transfer material and other contaminants other than toner on the photosensitive member 1 strongly adhere on the photosensitive member 1, it is necessary to scrape them to some extent by the cleaning blade 6A.

In practice, some of the toner wiped from the surface of the photosensitive member 1, which exists at the contact portion between the cleaning blade 6A and the photosensitive member 1, functions as a moderate lubricant to reduce the dynamic coefficient of friction between the photosensitive member 1 and the cleaning blade 6A. Hence, the cleaning blade 6A hardly produces scratches on the photosensitive member 1, and at the same time can properly scrape off adherent contaminants as well as toner on the photosensitive member 1.

To the contrary, since the contact charging blade 2A contacts the surface of the photosensitive member 1 cleaned by the cleaning blade 6A, there is no friction-reducing effect due to the lubricant-like function of toner as in the case of the cleaning blade 6A, and the photosensitive member 1 may easily be scratched.

The contact pressure of the blade to the photosensitive member causing the generation of scratches on the photosensitive member will now be investigated.

Figure 2:
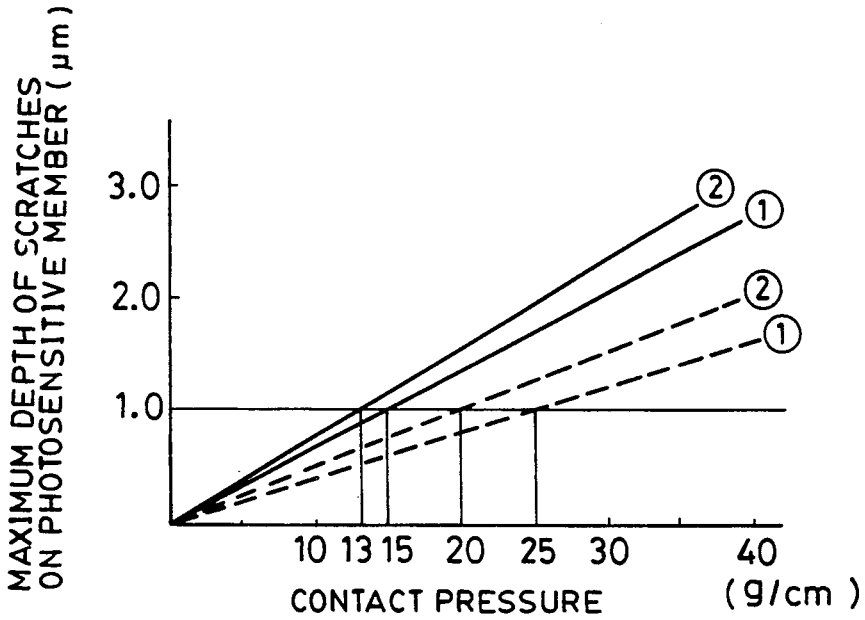
FIG. 2 is a graph showing the relationship between the contact pressure of a blade to an image carrying member and the depth of scratches on the image carrying member.

FIG. 2 is a graph showing the relationship between the contact pressure (g/cm) of the blade to the photosensitive member and the maximum depth (μm) of scratches on the photosensitive member.

In FIG. 2, broken lines represent the contact pressure (g/cm) per unit contact length (the length of a portion where the blade contacts the image carrying member in the longer direction of the image carrying member) of the cleaning blade 6A, and solid lines represent the contact pressure (g/cm) per unit contact length of the charging blade 2A.

In this case, an OPC (organic photoconductor) photosensitive member having a diameter of 30 mm is used as the photosensitive member, the surface layer (CTL (charge transfer layer)) of which is made of a binder consisting mainly of styrene-type resin or polycarbonate-type resin. In FIG. 2, the relationship between the contact pressure of the charging blade and the maximum depth of scratches on the photosensitive member is shown by solid lines, and the relationship between the contact pressure of the cleaning blade and the maximum depth of scratches on the photosensitive member is shown by broken lines. In FIG. 2, the maximum depth of scratches at the moment of the running distance of the photosensitive member of 180 m was measured. The solid lines were obtained by contacting only the charging blade to the photosensitive member and without contacting the cleaning blade to the photosensitive member. The broken lines were obtained by contacting only the cleaning blade to the photosensitive member and without contacting the charging blade to the photosensitive member. When both the charging blade and the cleaning blade are contacted to the photosensitive member, the maximum depth of scratches is not the sum of the maximum depths of scratches for the above-described two cases, but nearly coincides with the larger value between the values for the two cases. In FIG. 2, an OPC photosensitive member consisting mainly of polycarbonate-type resin was used for case ①, and an OPC photosensitive member consisting mainly of styrene-type resin was used for case ②.

As shown in FIG. 2, the maximum depth of scratches on the photosensitive member is proportional to the contact pressure of the blade to the photosensitive member, and the relationship $V \alpha \kappa \cdot L \cdot P / P_m$ holds, where V is the maximum depth of scratches of the photosensitive member, $\kappa$ is a coefficient relating to a frictional property between the photosensitive member and the blade, L is the running distance of the photosensitive member, P is the contact pressure of the blade to the photosensitive member, and $P_m$ is a coefficient representing hardness and fragility of the photosensitive member.

When the case of contacting only the cleaning blade 6A to the photosensitive member is compared with the case of contacting only the charging blade 2A, $P_m$ and the running distance L are constant because the identical photosensitive member is used for the both cases, and the difference between the two cases is determined by $\kappa$ and P. Although an image appears more or less differently according to the development method and conditions of a latent image, in the present experiment, the maximum depth of scratches was about 1.0 μm, and images having striped scratches, though fine, could be confirmed in half-tone images on the transfer materials.

Unlike in the case of the charging blade 2A, in the case of using the cleaning blade 6A, residual toner exists on the surface of the photosensitive toner which functions to reduce friction (perhaps through the action of rolling particles), as described before. Hence, in the case of contacting only the cleaning blade 6A, the frictional property $\kappa$ causing substantial scratches is reduced compared with the case of contacting only the charging blade 2A. Accordingly, if the contact pressure to the photosensitive member has an identical value, the maximum depth of scratches on the photosensitive member when only the cleaning blade 6A is contacted to the photosensitive member on which residual toner exists is reduced compared with the case when only the charging blade is contacted to the photosensitive member on which toner does not exist.

In the present experiment, single-component magnetic toner having an average particle size of 11 μm to which silica was externally added (0.4–0.6 weight part of silica for 100 weight part of toner) was used. Altough more or less different according to the quality of the material and the shape of toner, the tendency in the relationship between the contact pressure of the blade and the maximum depth of scratches on the photosensitive member shown in FIG. 2 nearly coincides with one another irrespective of toner used.

As described above, the contact pressure of the charging blade 2 and the cleaning blade 6A, particularly the contact pressure of the charging blade 2 to the photosensitive member is a factor for the life of the photosensitive member. The life of the photosensitive member becomes longer as the contact pressure is smaller. However, if the contact pressure of the cleaning blade 6A to the photosensitive member is too small, the photosensitive member is not sufficiently cleaned. In this case, since adherent contaminants on the photosensitive member are transferred to the charging surface of the charging blade, the contaminants are accumulated on the surface of the charging blade where they interfere with the charging operation.

The relationship between the contact pressure of the cleaning blade 6A and the maximum depth of scratches of the OPC photosensitive member consisting mainly of polycarbonate-type resin shown by the broken line (1) in FIG. 2 indicates that the minimum contact pressure of the cleaning blade 6A to the photosensitive member to provide an excellent cleaning property was 15 g/cm when using the single-component magnetic toner having an average diameter of 11 μm to which silica was externally added. That is, the contact pressure of the cleaning blade to the photosensitive member must be 15g/cm or more. However, as shown by the solid line (1) in FIG. 2, if the contact pressure of the charging blade 2A to the OPC photosensitive member consisting mainly of polycarbonate-type resin is made 15 g/cm or more, the maximum depth of scratches on the photosensitive member becomes 1.0 μm or more, and hence defects are produced in an image on the transfer material as described before. Accordingly, it is necessary to make the contact pressure of the charging blade to the photosensitive member smaller than 15 g/cm. That is, the contact pressure of the charging blade 2A to the OPC photosensitive member consisting mainly of polycarbonate-type resin on which toner does not exist must be smaller than the contact pressure of the cleaning blade 6A.

On the other hand, the relationship between the contact pressure of the blades and the maximum depth of scratches on the photosensitive member when using the OPC photosensitive member consisting mainly of styrene-type resin as the photosensitive member is shown by the lines (2) in FIG. 2. In this case, the minimum contact pressure of the cleaning blade 6A to the photosensitive member to provide an excellent cleaning property was 14 g/cm. That is, the contact pressure of the cleaning blade to the photosensitive member must be 14 g/cm or more. As shown by the solid line (2) in FIG. 2, if the contact pressure of the charging blade 2A is made 13 g/cm or more, the maximum depth of scratches on the photosensitive member becomes 1.0 μm or more, and hence defects are produced in an image. Accordingly, the contact pressure of the charging blade must be smaller than 13 g/cm. Also in this case, it is necessary to make the contact pressure of the charging blade 2A smaller than the contact pressure of the cleaning blade 6A.

It is to be noted that the minimum contact pressure of the cleaning blade 6A to the photosensitive member to provide an excellent cleaning property also changes according to the photosensitive member and toner. For example, the contact pressure of the cleaning blade 6A to the photosensitive member must be larger, as the average particle size of toner is smaller, and as the amount of external addition of silica is larger.

Furthermore, if contaminants on the photosensitive member have passed the cleaning blade 6A, the contaminants transferred to the charging blade 2A cause insufficient charging. That is, there is the possibility to produce this phenomenon if the contact pressure of the cleaning blade 6A is smaller than the contact pressure of the charging blade 2A. Accordingly, making the contact pressure of the cleaning blade 6A larger than the contact pressure of the charging blade 2A has the effect to stabilize the charging operation, since fewer contaminants on the photosensitive member pass the cleaning blade 6A.

The maximum depth of scratches on the photosensitive member also changes according to the running distance of the photosensitive member, that is, according to the number of printed sheets in the image forming apparatus. The moment at which the maximum depth of scratches on the photosensitive member reaches a depth to produce defects in an image may be set as the life of the process cartridge.

Furthermore, the charging blade 2A is warped more easily than the cleaning blade 6A, the dynamic coefficient of friction of which is reduced since adherent contaminants invervene between the cleaning blade 6A and the photosensitive member. The warp of the charging blade 2A may cause insufficient charging for the photosensitive member, or deteriorate the charging blade 2A. Accordingly, in the process cartridge provided with the two blades and the image carrying member, it is effective to make the contact pressure of the charging blade 2A to the photosensitive member smaller than the contact pressure of the cleaning blade 6A to the photosensitive member to adjust the life of the two blades.

The following conditions exist in order to provide a difference in the pressure to the photosensitive member between the cleaning blade 6A and the charging blade 2A where suffix "1" is used to refer to the cleaning blade and the suffix "2" is used for the charging blade. The state $P_1 > P_2$ for the contact pressure may be provided by making $t_1 > t_2$ for the thickness, $\mathbf{1}_1 < \mathbf{1}_2$ for the free length (the length from the support portion of the blade to the front end portion of the blade, which corresponds to "1" in FIG. 1), $E_1 > E_2$ for the modulus of elasticity (Young's modulus), $\delta_1 > \delta_2$ for the amount of displacement (in the direction of the normal of the photosensitive member), and the like, and combinations of these conditions.

Figures 3A, 3B, 3C:
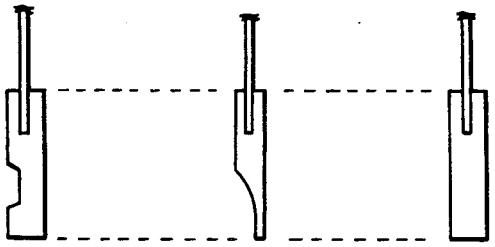
FIGS. 3(*a*)–3(*c*) are cross-sectional views showing the shapes of blades which can be applied to the present invention.

It is also possible to provide higher accuracy and to simplify the production, assembly and inspection by setting the free length of the two blades, the modulus of elasticity of the material and the amount of displacement to identical values, and to provide a difference in the pressure by changing the shape of the cross section, as shown in FIG. 3.

FIG. 3 shows the shapes of the cross sections of blades. In FIG. 3(*a*), the thickness of the portion between the support portion (top) and the free end portion (the portion contacting the photosensitive member) of the blade is made smaller than the thickness of those other two portions. In FIG. 3(*b*), the thickness of the free end portion of the blade is made smaller than the thickness of the support portion of the blade. In FIG. 3(*c*), the thickness of the blade is nearly constant from the support portion to the free end portion of the blade. In FIG. 3, when the material of the blade is common, the thickness at the support portion of the blade is equal and the amount of displacement at the moment of contacting the blade to the photosensitive member is identical for all the above-desribed cases, the contact pressure to the photosensitive member decreases in the descending order of the cases (c), (a) and (b).

Figure 4:
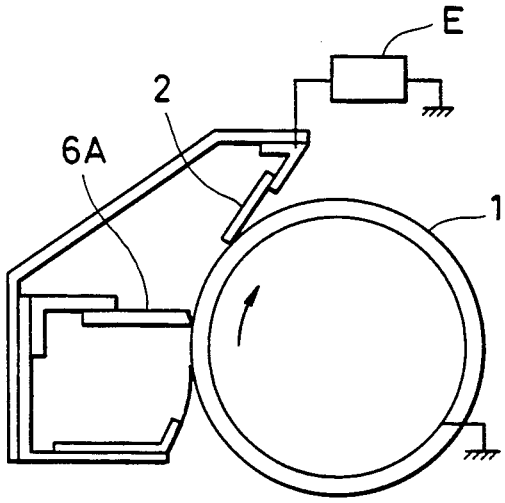
FIGS. 4(*a*)–4(*b*) are cross-sectional views showing the contact directions of a charging blade and a cleaning blade relative to an image carrying member.
Figure 4:
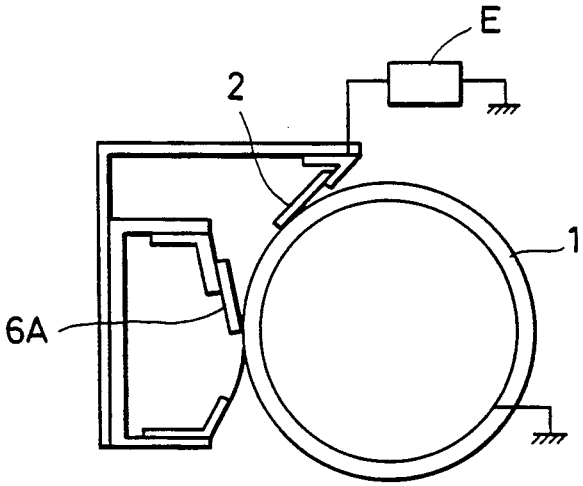

As shown in FIG. 4, the cleaning blade 6A may be contacted with the photosensitive member 1 in the so-called forward direction having an obtuse angle with the tangent at the already-cleaned side of the photosensitive member at the contact position (see FIG. 4(*a*)), or may be contacted in the so-called counterdirection having an acute angle with the tangent. Furthermore, the charging blade 2 is not necessarily contacted with the photosensitive member 1 in the counterdirection, as shown in FIG. 4, but it may be contacted in the forward direction.

EXAMPLE

An OPC photosensitive member consisting mainly of polycarbonate-type resin was used as the photosensitive member 1. An urethane rubber blade having a JIS (Japanese Industrial Standards) A hardness of 65° was used as the cleaning blade 6A, which was contacted to the photosensitive member 1 with the contact pressure of 14 g/cm. A conductive EPDM rubber blade having the resistivity of $10^6$–$10^9\Omega\cdot$cm was used as the contact charging blade 2A, which was contacted to the photosensitive member with the contact pressure of 10 g/cm which is smaller than the contact pressure of the cleaning blade 6A. Biasing voltage composed of A.C. voltage $V_{pp}$ (peak-to-peak voltage) of 1500 V (volts) and having the frequency of 800 Hz (Herz) superposed on D.C. voltage of 700 V was applied to the blade 2. Charging potential of about 700 V was provided on the surface of the photosensitive member, and durability test was performed.

The charging blade may be coated with an insulating layer (having the resistivity of $10^8$–$10^{12}\Omega\cdot$cm) 100 μm thick or less on its surface layer.

By making the contact pressure of the contact charging blade to the photosensitive member smaller than the contact pressure of the cleaning blade, as described above, defects in images due to scratches on the photosensitive member by the charging blade were not produced even during the durability test of 3000 sheets, and cleaning and charging operations were favorably performed.

It is to be noted that the term "charging" not only indicates the operation to provide electric charges on the image carrying member, but also includes the operation to remove electric charges from the image carrying member.

For example, the photosensitive member may previously be charged by the transfer roller 5 shown in FIG. 1 to desired potential necessary to form a latent image, and electric charges may then be removed by the grounded charging blade 2A so that the photosensitive member is at the desired potential.

As described above, according to the present invention, the contact state of the charging blade to the image carrying member is stabilized, and hence stability of the contact charging operation is obtained. Furthermore, it is possible to reduce damages in the image carrying member.

What is claimed is:

1. A process kit detachable relative to an image forming apparatus, comprising:

a movable image carrying member;

cleaning means including a blade-like cleaning member for contactably cleaning said image carrying member; and charging means including a blade-like charging member for contactably charging said image carrying member at a side downstream in the direction of movement of said image carrying member from said cleaning member;

wherein the contact pressure of said charging member to said image carrying member is made smaller than the contact pressure of said cleaning member to said image carrying member.

2. A process kit according to claim 1, further comprising image forming means for forming an image on the image carrying member.

3. A process kit according to claim 2, wherein said image forming means comprises said charging means.

4. A process kit according to claim 1, wherein said image carrying member is a photosensitive member.

5. A process kit according to claim 4, wherein said photosensitive member is made of an organic photoconductor.

6. A process kit according to claim 5, wherein said photosensitive member is made of an organic photoconductor including polycarbonate-type resin.

7. A process kit according to claim 6, wherein the contact pressure of said charging member is less than 15 g/cm and the contact pressure of said cleaning member is 15 g/cm or more than 15 g/cm.

8. A process kit according to claim 5, wherein said photosensitive member is made of an organic photoconductor including styrene-type resin.

9. A process kit according to claim 8, wherein the contact pressure of said charging member is less than 13 g/cm and the contact pressure of said cleaning member is 14 g/cm or more than 14 g/cm.

10. A process kit according to claim 1, wherein the thickness of said blade-like charging member is smaller than the thickness of said blade-like cleaning member.

11. A process kit according to claim 1, wherein the free length of said blade-like charging member is larger than the free length of said blade-like cleaning member.

12. A process kit according to claim 1, wherein both said blade-like charging member and said blade-like cleaning member have elasticity.

13. A process kit according to claim 12, wherein the modulus of elasticity of said blade-like charging member is smaller than the modulus of elasticity of said blade-like cleaning member.

14. A process kit according to claim 11, wherein an amount of displacement of said blade-like charging member is smaller than an amount of displacement of said blade-like cleaning member in a direction normal to said image carrying member.

15. An image forming apparatus comprising:

a movable image carrying member;

image forming means for forming an image on said image carrying member;

cleaning means including a blade-like cleaning member for contactably cleaning said image carrying member; and charging means including a blade-like charging member for contactably charging said image carrying member at a side downstream in the direction of movement of said image carrying member from said cleaning member;

wherein the contact pressure of said charging member to said image carrying member is made smaller than the contact pressure of said cleaning member to said image carrying member.

16. An image forming apparatus according to claim 15, wherein said image forming means comprises latent image forming means for forming a latent image on said image carrying member and developing means for developing the latent image, and said apparatus further comprises transfer means for transferring the developed image to a transfer material.

17. An image forming apparatus according to claim 16, wherein said latent image forming means comprises said charging means.

18. An image forming apparatus according to claim 17, wherein said image carrying member is a photosensitive member, and wherein said latent image forming means includes exposure means for exposing the photosensitive member charged by said blade-like charging member in accordance with the image.

19. An image forming apparatus according to claim 18, wherein said photosensitive member is made of an organic photoconductor.

20. An image forming apparatus according to claim 19, wherein said photosensitive member is made of an organic photoconductor including polycarbonate-type resin.

21. An image forming apparatus according to claim 20, wherein the contact pressure of said charging member is less than 15 g/cm and the contact pressure of said cleaning member is 15 g/cm or more than 15 g/cm.

22. An image forming apparatus according to claim 19, wherein said photosensitive member is made of an organic photoconductor including styrene-type resin.

23. An image forming apparatus according to claim 22, wherein the contact pressure of said charging member is less than 13 g/cm and the contact pressure of said cleaning member is 14 g/cm or more than 14 g/cm.

24. An image forming apparatus according to claim 15, wherein the thickness of said blade-like charging member is smaller than the thickness of said blade-like cleaning member.

25. An image forming apparatus according to claim 15, wherein the free length of said blade-like charging member is larger than the free length of said blade-like cleaning member.

26. An image forming apparatus according to claim 15, wherein both said blade-like charging member and said blade-like cleaning member have elasticity.

27. An image forming apparatus according to claim 26, wherein the modulus of elasticity of said blade-like charging member is smaller than the modulus of elasticity of said blade-like cleaning member.

28. An image forming apparatus according to claim 15, wherein an amount of displacement of said blade-like charging member is smaller than an amount of displacement of said blade-like cleaning member in a direction normal to said image carrying member.

29. An image forming apparatus according to claim 15, wherein said charging means comprises voltage application means for applying voltage to said blade-like charging member.

* * * * *